United States Patent [19]

Gagnon et al.

[11] 4,199,133

[45] Apr. 22, 1980

[54] BATTENS SYSTEM FOR RAISING AND LOWERING SCENERIES ON A STAGE

[76] Inventors: Pierre Gagnon, 5637 Wilderton St., Montreal, Canada, H3T 1S1; Pierre Laforest, 1945 Bruxelles St., Montreal, Canada, H3T 1S1

[21] Appl. No.: 885,068

[22] Filed: Mar. 9, 1978

[51] Int. Cl.[2] ..... B66C 23/60

[52] U.S. Cl. ..... 254/141; 272/22; 160/334

[58] Field of Search ..... 254/141, 139, 144, 150 R, 254/152, 153, 167, 168, 175, 178, 184, 186 R, DIG. 11; 272/22; 242/107.6, 107.3, 7.19, 7.21, 7.22; 188/77 W, 82.6

[56] References Cited

U.S. PATENT DOCUMENTS

| | | | |
|---|---|---|---|
| 1,911,601 | 5/1933 | Boughton | 242/7.22 |
| 2,112,865 | 4/1938 | Putnam | 242/7.22 |
| 2,659,573 | 11/1953 | Smith, Sr. | 254/152 |
| 2,776,815 | 1/1957 | Sheard | 254/186 R |
| 2,942,879 | 6/1960 | Izenour | 254/141 |
| 3,052,426 | 9/1962 | Avis | 254/152 |
| 3,368,796 | 2/1968 | Ulbing | 254/186 R |
| 3,804,370 | 4/1974 | Woodard | 254/186 R |
| 3,836,123 | 9/1974 | Bausenbach et al. | 254/186 R |
| 3,977,652 | 8/1976 | Mauch | 188/82.6 |

*Primary Examiner*—Kenneth W. Noland

[57] ABSTRACT

A battens system for raising and lowering sceneries or other loads on a stage is disclosed. The system comprises a support, a roller upon which at least one cable supporting a scenery is wound, a bearing assembly secured to the support for rotatably mounting the roller and including inclined bearings for longitudinally moving such roller at each turn by a distance equal to the pitch of the cable wound on or unwound from the roller, and a drive for rotating such roller.

8 Claims, 7 Drawing Figures

BATTENS SYSTEM FOR RAISING AND LOWERING SCENERIES ON A STAGE

SUBJECT OF THE INVENTION

This invention relates to a battens system for raising and lowering sceneries on a stage.

BACKGROUND OF THE INVENTION

Up to now, it has been the general practice to raise and lower sceneries manually by means of cables passed through pulleys secured to suitable supports of the stage. The cables are generally passed through further pulleys up to a control station where an operator is located. Counterweights are normally attached to the other end of the cables to balance the weight of the sceneries. In a complex play, it is common to have up to fifty battens which have to be operated at some time during the play. This oftens requires the attendance of several operators, which increases the cost of labor and also takes a lot of space on the stage. The known systems are also often unsafe for the people on the stage.

SUMMARY OF THE INVENTION

It is therefore the object of the present invention to provide a system which may be easily operated by a single operator from a control desk.

It is also an object of the present invention to provide a breaking mechanism for a battens system, which is safe and will stop automatically whenever the scenery hits an obstacle.

The battens system in accordance with the invention comprises a support, a roller upon which at least one cable supporting a scenery or other loads is wound, a bearing assembly secured to such support for rotatably mounting the roller and including means for longitudinally moving the roller at each turn by a distance equal to the pitch of the cable wound on or unwound from the roller, and means for rotating such roller.

The means for longitudinally moving the roller preferably includes a number of roller bearings engaging the outside surface of the roller. The roller bearings are mounted on axes located at a predetermined angle with respect to the axis of the roller, so as to cause longitudinal movement of the roller as it is rotated in the roller bearings. There are preferably three roller bearings spaced approximately 120 degrees, one of the roller bearings being radially movable with respect to the axis of the roller, so as to permit adjustment of the roller bearings on the roller.

The battens system is preferably provided with a braking mechanism engaging the roller in the downward movement of the sceneries for imparting a predetermined braking torque to the roller. The braking mechanism comprises a tubular member mounted outside the roller; a clutch device is mounted within the tubular member and including a spiral member, wound a few turns around the roller and secured to the tubular member at one end, the spiral member frictionally engaging the roller in the downward movement of the scenery when the roller rotates in a direction such as to tighten the spiral member around the roller, but exerting no substantial braking action on the roller when the roller is rotated in the opposite direction; and friction means for resisting rotation of the tubular member. Such friction means preferably include a disc secured to, or integral with, the tubular member and brake shoes engaging such disc and located on the support of the roller.

In order to make the braking mechanism suitable for use with a roller which is movable longitudinally, guide means are secured to the above support and extend parallel to the roller, and the above-mentioned brake shoes are secured to a guide follower which is jounalled on the roller and engage such guide. The brake shoes are adjustable for controlling the braking torque applied to the roller.

BRIEF DESCRIPTION OF THE DRAWINGS

The invention will now be disclosed, by way of example, with reference to the accompanying drawings, in which.

PREFERRED EMBODIMENT OF THE INVENTION

Figure 1:
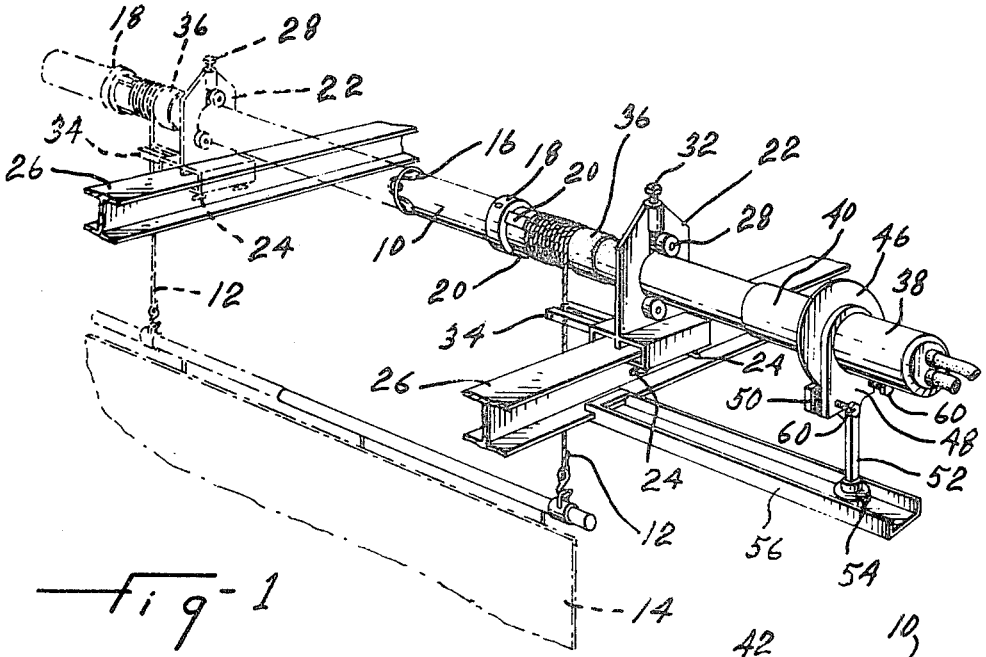
FIG. 1 illustrates a perspective view of the battens system in accordance with the invention.
Figure 2:
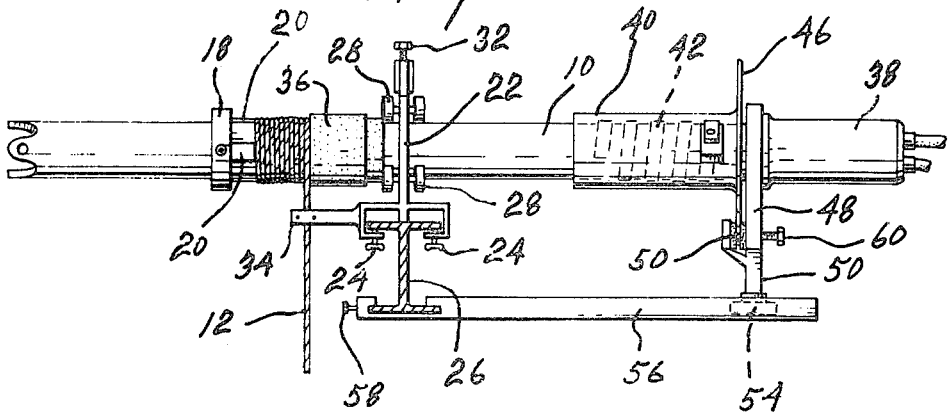
FIG. 2 illustrates a side view of the battens system of FIG. 1.
Figures 3, 4, 5, 7:
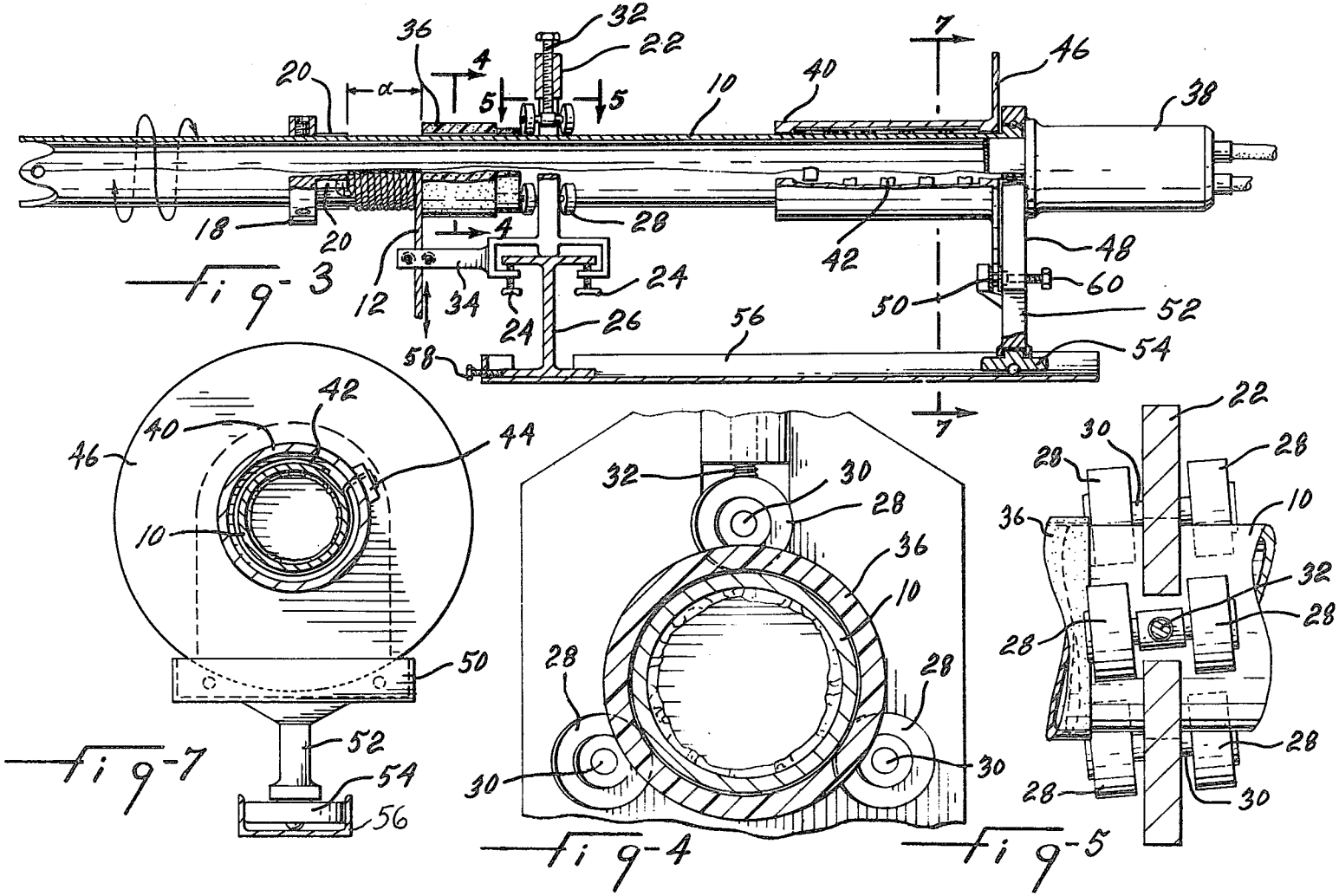
FIG. 3 illustrates a partial section view through the battens system of FIG. 1.
FIG. 4 illustrates a section view through lines 4—4 of FIG. 3.
FIG. 5 illustrates a section view through lines 5—5 of FIG. 3.
FIG. 7 illustrates a section view along lines 7—7 of FIG. 3.

Referring to FIGS. 1, 2, 3, there is shown an embodiment of a battens system in accordance with the invention comprising a roller 10 upon which is wound a cable 12 supporting a scenery 14. The roller 10 is made of two sections joined by a universal joint 16. The roller is preferably made of a plurality of sections joined together for easy installation. Each cable 12 is secured at one end to the roller 10 by means of a collar 18. To each collar is secured a number of spacers 20 of increasing length, which determine the pitch of the cable being wound on the roller.

Referring more particularly to FIGS. 3, 4, and 5, the roller 10 is rotatably mounted in at least two bearing assemblies, including a vertical plate 22 secured, by means of screws 24, to supports 26 extending near the ceiling of the stage and three sets of roller bearings 28, mounted on plate 22 and spaced at about 120 degrees. Each set of roller bearings is mounted on a shaft 30 which is at a predetermined angle with respect to the axis of the roller 10, so as to cause longitudinal movement of the roller, at each turn of the roller, by a distance equal to the pitch of the cable being wound on the roller. Two of the shafts are secured to plate 22, but the third one is radially movable by means of a screw 32, so as to permit adjustment of the bearing on the roller. More than three roller bearings could obviously be used.

The cable 10 is guided by a guide member 34 secured to plate 22, so as to ensure that the scenery will not move transversely as the roller is rotated. A plastic cylinder 36 is also mounted on the roller 10 for guiding the cable being wound on the roller.

The roller 10 is rotated in both directions by means of a lever support hydraulic motor 38, which is directly coupled to the roller 10. An electric motor could also be used.

Figure 6:
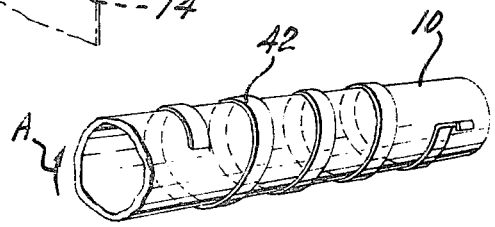
FIG. 6 illustrates a partial view of the braking mechanism of the battens system in accordance with the invention.

A braking mechanism is provided for preventing rotation of the roller under the weight of the scenery attachment to the cable wound on the roller. Such braking mechanism includes a tubular member 40 mounted on the roller and a clutch device located within the tubular member and including a spiral member 42, shown more clearly in FIG. 6, and having one end thereof secured to tubular member 40, as shown at 44 in FIG. 7. A disc 46 is made integral with, or secured to, tubular member 40. A plate 48 is journalled on roller 10 and is provided with brake shoes 50 engaging disc 46. Plate 48 is also secured to the housing of motor 38. Rotation of the motor housing due to the counter-torque exerted on the same, and of plate 48 with disc 46, is prevented by means of arm 52 secured to plate 48 and provided with a guide follower 54 engaging a guide 56 extending parallel to roller 10 and secured to support 26 by means of screw 58. The braking torque applied on disc 46 by the shoes 50 is controlled by screws 60.

The above-described battens system operates as follows:

When the motor 38 is energized to rotate the roller 10 in a direction such as to raise the scenery, the bearings 22, which are located on shafts having a predetermined angle with respect to the axis of the roller, will cause the roller to move to the left, at each turn, by a distance equal to the pitch of the cable, as determined by spacers 20.

The cable 10 will thus be wound nicely on the roller for a distance alpha, as illustrated in FIG. 3. Such distance depends, of course, on the height of the stage, the diameter of the roller and also on the diameter of the cable. The reverse will happen during lowering of the scenery. During its upward and downward movements, the cable 12 is guided by guide 34 and cylindrical member 36; but this is not essential since bearings 22 ensure longitudinal movement of the roller, so that the cable 12 does not move transversely.

The braking mechanism prevents unwinding of the cable under the weight of the scenery. The braking action is caused by spiral member 42 wound around roller 10 and secured at one end to tubular member 40. Indeed, when roller 10 tends to rotate in the direction indicated by arrow A in FIG. 6, the frictional force between spiral member 42 and roller 10 is increased, because the spiral is tightened around the roller. Thus, tubular member 40 is forced to rotate in unison with roller 10 but is resisted in its movement by the braking action of brake shoes 50 acting on disc 46 secured to tubular member 40. On the contrary, when roller 10 is rotated in the opposite direction to raise the scenery, spiral member 42 is untightened around roller 10 and no substantial braking action is exerted. The braking torque is adjusted by screws 60 so as to exceed the torque exerted on the roller by the weight of the scenery. Such braking torque is preferably set at twice the torque exerted on the roller by the weight of the scenery.

The pressure applied to hydraulic motor 38 is adjusted by any suitable means, such as a valve (not shown), so as to apply adequate torque to the roller 10 to raise the scenery at a predetermined speed. This toruqe only needs to be slightly higher than that necessary to overcome the weight of the scenery, since the braking mechanism is disengaged during raising of the scenery. Upon reversal of the hydraulic flow in the motor 38 to lower the scenery, the required torque will be that needed to overcome the torque of the braking mechanism, minus the one provided by the weight of the scenery. Thus, when the scenery hits the floor, or an obstacle, the motor will automatically stop as the torque derived from the weight of the scenery will not any more be added to the one of the motor to overcome the torque of the braking mechanism. The above braking arrangement thus provides a positive stop of the scenery which is safe to the people on the stage.

The above-disclosed battens system is a great improvement over the known systems, as it takes up much less space on the stage, since no pulleys and counterweights are required. With the prior art systems, a full wall of the stage was often taken, as some stages had up to fifty battens. With the present invention, the battens are positioned above the stage one beside the other to operate as many sceneries as needed. The only equipment on the stage is a control desk.

Although the invention has been disclosed with reference to a preferred embodiment, it is to be understood that other alternative embodiments are also envisaged. For example, other types of bearing assemblies for moving the roller longitudinally could be used. The braking mechanism could also take various forms. Each roller could obviously operate plural sceneries located a predetermined distance apart in synchronism by providing additional cables wound on the roller and passing such cables through a system of pulleys secured to the ceiling of the stage.

What we claim is:

1. A battens system comprising:

(a) support means;

(b) a generally horizontally disposed roller upon which at least one cable supporting a scenery or other load is wound;

(c) bearing assemblies secured to said support means at spaced zones along said roller, for rotatably mounting said roller, each bearing assembly including a number of roller bearings engaging the outside surface of the roller, said roller bearings being mounted on axes located at a predetermined angle with respect to the axis of the roller, said angle selected so that rotation of said roller causes said roller bearings to move said roller longitudinally at each turn by a distance equal to the pitch of the cable wound on or unwound from the roller;

(d) means for rotating said roller;

(e) guide means secured to said support means and extending parallel to said roller;

(f) a tubular member mounted outside said roller and rotatable relative to the same, a brake disk secured to said tubular member, a guide follower journalled on said roller and engaging said guide means, adjustable brake shoes carried by said guide follower and engaging said disc; and (g) a unidirectional clutch device carried by said tubular member and effecting clutching of said tubular member to said roller when the latter rotates in a direction to effect downward movement of the scenery and effecting declutching of said tubular member from said roller when the latter rotates in the opposite direction to effect raising movement of the scenery, whereby said brake shoes apply an adjustable brake torque to the roller only in the downward movement of the scenery or the like load.

2. A system as defined in claim 1, wherein said unidirectional clutch device includes a spiral member wound a few turns around said roller and secured to said tubular member at one end, said spiral member frictionally engaging said roller in the downward movement of the scenery when the roller rotates in a direction such as to tighten the spiral member around the roller, but exerting no substantial braking action on the roller when the roller is rotated in the opposite direction.

3. A battens system comprising:

(a) support means;

(b) a generally horizontally disposed roller upon which at least one cable supporting a scenery or other load is wound;

(c) bearing assemblies secured to said support means at spaced zones along said roller, for rotatably mounting said roller, each bearing assembly including a number of roller bearings engaging the outside surface of the roller, said roller bearings being mounted on axes located at a predetermined angle with respect to the axis of the roller, said angle selected to that rotation of said roller causes said roller bearings to move said roller longitudinally at each turn by a distance equal to the pitch of the cable wound on or unwound from the roller;

(d) a reversible motor having a housing and a driving shaft, said driving shaft secured to an end of said roller and coaxial with said roller, whereby said motor moves longitudinally with said roller, guide means secured to said support means close to said motor and extending parallel to and spaced from said roller, an arm secured to said motor housing, extending radially therefrom and provided with a guide follower engaging said guide means to prevent rotation of said motor housing due to the counter-torque exerted on the same, while allowing longitudinal movement of said motor together with said roller.

4. A battens systems as claimed in claim 3, further including a tubular member mounted outside said roller and rotatable relative to the same, a brake disc secured to said tubular member, adjustable brake shoes carried by said arm and engaging said disc, and a unidirectional clutch device carried by said tubular member and effecting clutching of said tubular member to said roller when the latter rotates in a direction to effect downward movement of the scenery and effecting declutching of said tubular member from said roller when the latter rotates in the opposite direction to effect raising movement of the scenery, whereby said brake shoes apply an adjustable brake torque to the roller only in the downward movement of the scenery.

5. A battens system as claimed in claim 3, wherein there are three roller bearings spaced approximately at 120 degrees, one of said roller bearings being radially movable with respect to the axis of said roller, so as to permit adjustment of the roller bearings on the roller.

6. A system defined in claim 3 or 5, wherein said reversible motor is a hydraulic motor.

7. A battens system comprising:

(a) a generally horizontally disposed elongated roller upon which at least one cable for supporting a scenery or other load is wound;

(b) a reversible motor having a driving shaft secured to an end of said roller to rotate said roller in either one of two directions;

(c) bearing assemblies spaced along said roller for supporting said roller at spaced zones along the length thereof, each bearing assembly including a support and roller bearings carried by said support and engaging the outside surface of said roller at spaced points around said roller and rotatably supporting said roller, said roller bearings being mounted on axes located at a predetermined angle with respect to the axis of said roller, said angle selected so that rotation of said roller causes said roller bearings to move said roller longitudinally at each turn by a distance equal to the pitch of the cable wound on or unwound from the roller, said reversible motor has an arm secured to the motor housing and where the arm is slidably supported along a fixedly supported guide means extending parallel to said roller and functioning to prevent rotation of the motor housing.

8. A battens system as claimed in claim 7, wherein said roller consists of at least two sections joined in end-to-end relationship by a universal joint, a bearing assembly being provided for each section and a cable being wound on each section.

* * * * *